US005086719A

United States Patent [19]

Ogawa

[11] Patent Number: 5,086,719

[45] Date of Patent: Feb. 11, 1992

[54] SEWING MACHINE PROVIDED WITH A THREADING DEVICE AND A NEEDLE BAR RAISING DEVICE

[75] Inventor: Masao Ogawa, Nagoya, Japan

[73] Assignee: Brother Kogyo Kabushiki Kaisha, Japan

[21] Appl. No.: 583,315

[22] Filed: Sep. 17, 1990

[30] Foreign Application Priority Data

Oct. 31, 1989 [JP] Japan ..... 1-285197

[51] Int. Cl.[5] ..... D05B 87/02; D05B 55/14

[52] U.S. Cl. ..... 112/225; 112/221

[58] Field of Search ..... 112/220, 221, 224, 225, 112/237, 238, 240, 241, 254, 284, 302

[56] References Cited

U.S. PATENT DOCUMENTS

| | | | |
|---|---|---|---|
| 893,698 | 7/1908 | Battey | 112/225 |
| 2,704,526 | 3/1955 | Benink et al. | 112/225 |
| 2,727,479 | 12/1955 | Meissler | 112/225 |
| 2,739,553 | 3/1956 | Zink et al. | 112/225 |
| 2,910,029 | 10/1959 | Herbst | 112/225 |
| 3,002,476 | 10/1961 | Capelli | 112/225 |
| 3,485,194 | 12/1969 | Eguchi | 112/225 |
| 3,505,965 | 4/1970 | Smith | 112/225 |
| 4,023,512 | 5/1977 | Miyamoto | 112/225 |
| 4,098,207 | 7/1978 | Peterson | 112/221 |
| 4,185,574 | 1/1980 | Totino et al. | 112/225 |
| 4,335,591 | 10/1982 | Itoh et al. | 112/225 |
| 5,003,899 | 4/1991 | Ogawa | 112/225 X |

FOREIGN PATENT DOCUMENTS 63-89194 4/1988 Japan .

*Primary Examiner*—Werner H. Schroeder
*Assistant Examiner*—Ismael Izaguirre
*Attorney, Agent, or Firm*—Oliff & Berridge

[57] ABSTRACT

A sewing machine comprising a threading device and a needle-bar raising means. A threading switch is operated and a sewing machine motor is stopped. Subsequently, thread is passed onto a linkage, a needle bar is disconnected from an arm shaft, and the needle bar is raised to a given position. After the needle bar is set in its uppermost position, thread stretched out from the linkage 38 to the front of an eye in a needle is passed through the eye in the needle. If the end of thread is manually held in front of the eye in the needle to stretch out prior to threading operation, the needle bar does not lower, thus enhancing operational safety and preventing thread from loosening.

21 Claims, 6 Drawing Sheets

SEWING MACHINE PROVIDED WITH A THREADING DEVICE AND A NEEDLE BAR RAISING DEVICE

BACKGROUND OF THE INVENTION

This invention relates to a sewing machine that is provided with a threading device for threading an eye in a needle with thread.

A sewing machine provided with a threading device is disclosed in Japan Published Unexamined Patent Application No. S63-89194. The threading device includes a stretching member for catching thread and stretching out the thread prior to threading, and a threading member such as a threading hook for threading a needle. In related-art sewing machines, an operator holds the end of thread and stretches the thread in front or at the rear of an eye in a needle. Subsequently, a threading hook is brought through the eye in the needle to hook the thread and thread the eye in the needle.

In the above related-art sewing machines, the threading hook is moved toward the eye in the needle for threading. Before the needle is thus threaded, a needle bar is raised to a position such that the threading hook can come through the eye in the needle attached to the end of the needle bar without contacting other component such as a presser foot assembly.

However, the related-art sewing machines have the following problem.

(1) The eye in the needle should be raised to a given position before the thread is stretched out in front or at the rear of the eye in the needle. Threading operation is thus intricate.

(2) To put the thread onto a stretching member for stretching out the thread before the threading of the needle, an arm shaft is rotated. The needle may lower in its stroke according to the rotation of the arm shaft, and a thread guide attached to the needle bar lowers and draws thread from a bobbin or the stretching member, thereby loosening the thread. Since the thread cannot be stretched out at a given position, the threading member fails to thread the eye in the needle.

(3) If the operator holds the end of the thread passed through the thread guide attached to the lower end of the needle bar and rotates the arm shaft to stretch out the thread at a given position, the needle may lower according to the stroke of the needle corresponding to the rotation of the arm shaft. The operator might be hurt at the lowering needle.

In the related art, the eye in the needle must be raised to the given position before the thread is stretched out.

SUMMARY OF THE INVENTION

The object of this invention is to provide a sewing machine that can position a needle eye in a given position and stretch out thread prior to the threading of a needle eye.

To attain this and other objects, the invention provides a sewing machine including a threading device for threading an eye in a needle attached to the lower end of a needle bar vertically movable for sewing operation, and a needle-bar raising means for raising the needle bar to a given position prior to a threading operation regardless of vertical movement of the needle bar for sewing operation.

DETAILED DESCRIPTION OF THE PREFERRED EMBODIMENT

Figure 1:
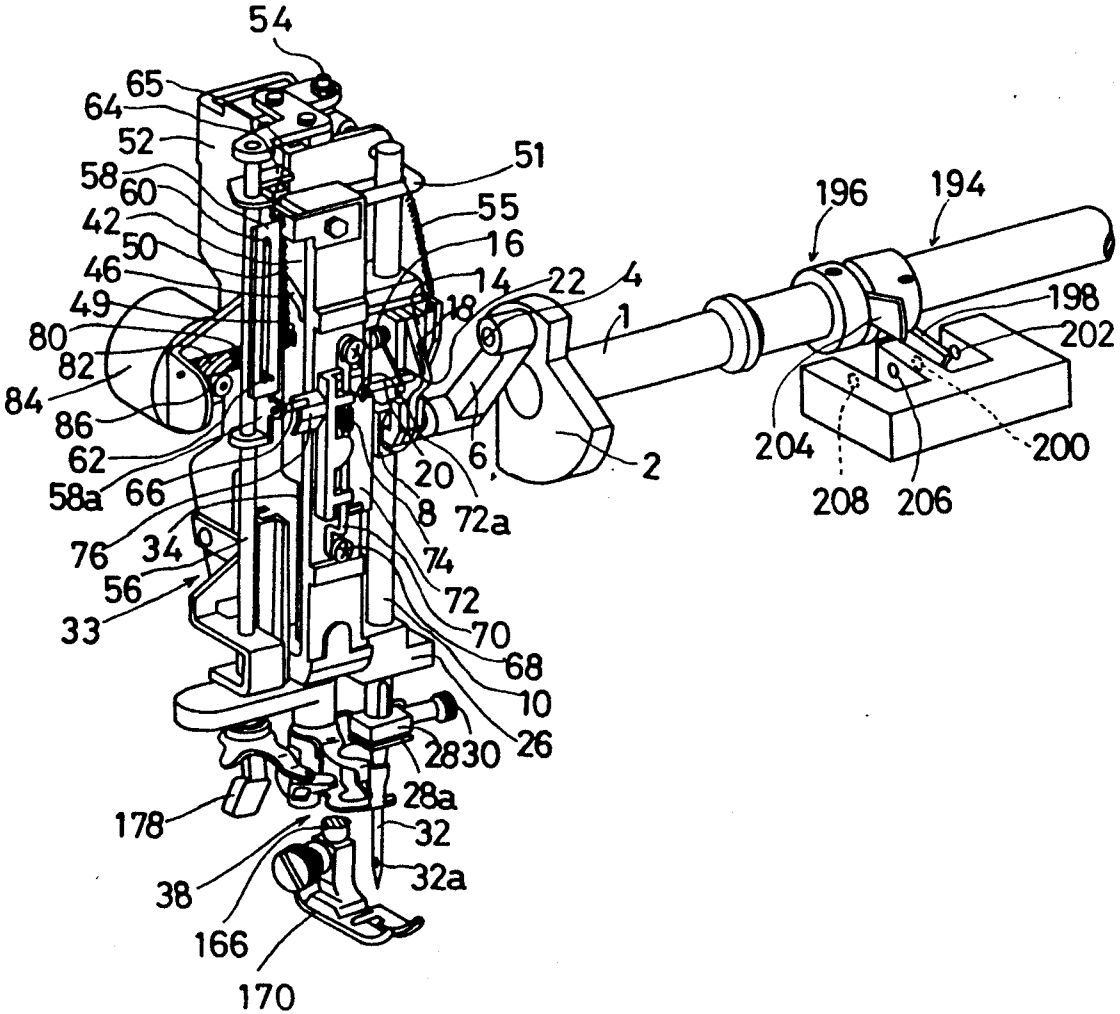
FIG. 1 is a partial perspective view of a sewing machine embodying this invention.
Figure 3:
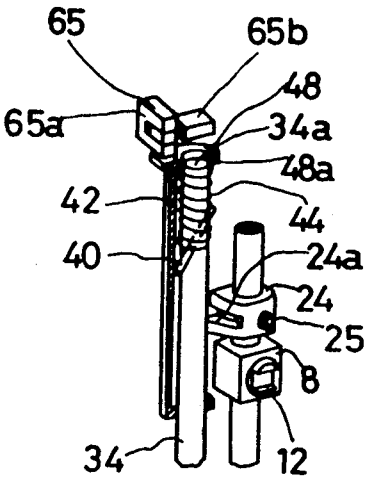
FIG. 3 is a partial perspective view of a positioning stopper and its adjoining components for the embodiment.

As shown in FIG. 1, an arm shaft 1 is driven and rotated through a sewing-machine motor (not shown). A crankpin 4 is set on a counterbalance 2 on the arm shaft 1. One end of a connecting rod 6 is rotatably inserted into the crankpin 4, and a needle-bar connecting stud 8 is rotatably inserted into the other end of the connecting rod 6. The needle-bar connecting stud 8 is slidably engaged on a needle bar 10. As shown in FIG. 3, a groove 12 radially and horizontally extends in the needle-bar connecting stud 8.

A needle bar frame 14 is attached to the needle bar 10. A stud 16 is inserted into the needle bar frame 14 and slidably supports a clutch latch 18 in the needle bar frame 14. One end of a torsion spring 22 is attached to the stud 16, and the other end of the torsion spring 22 is engaged on a clutch pin 20 inserted into the clutch latch 18 perpendicularly to the needle bar 10. The torsion spring 22 applies a force to the clutch latch 18 so that the end of the clutch latch 18 engages the groove 12 in the needle-bar connecting stud 8. The clutch latch 18 can be engaged to and disengaged from the groove 12 through the torsion spring 22. As shown in FIG. 3, a positioning stopper 24 is secured through a screw 25 onto the needle bar 10 at a predetermined position above the needle-bar connecting stud 8. A projection 24*a* projects from the positioning stopper 24 perpendicularly to the axial direction of the needle bar 10.

Figure 2:
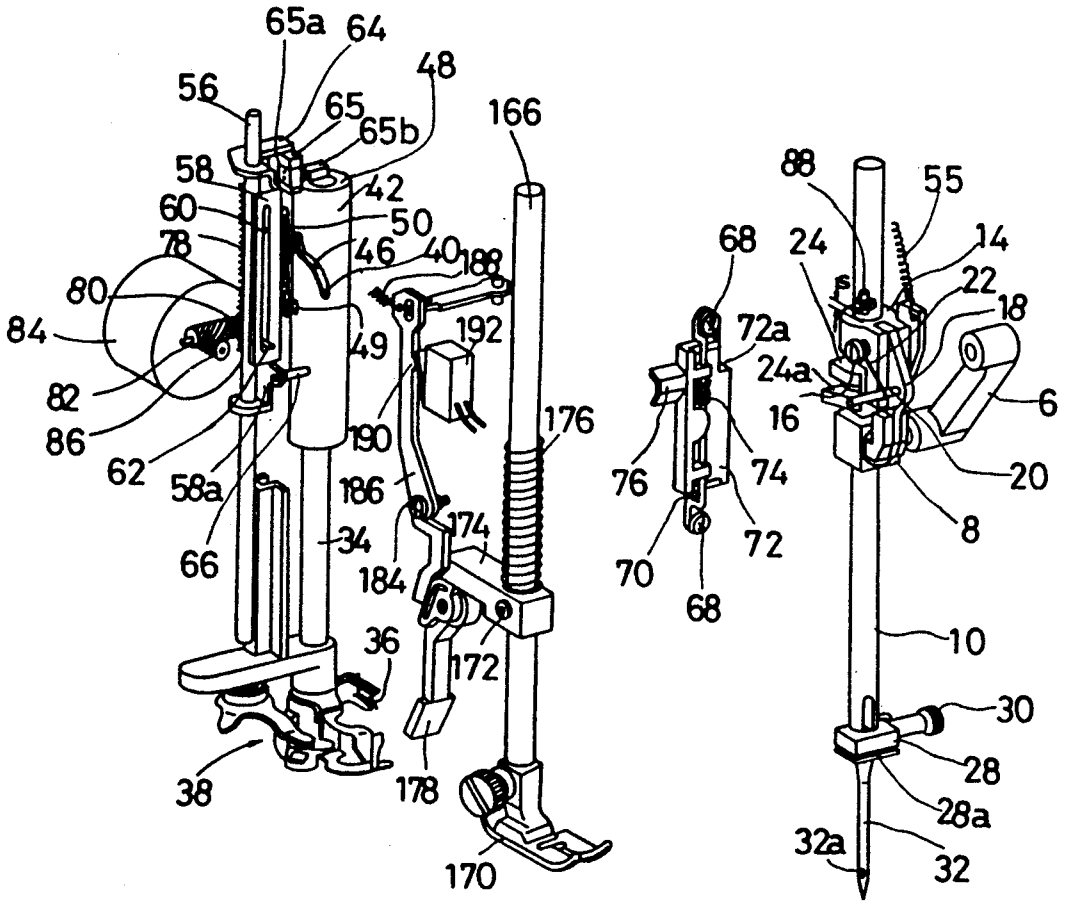
FIG. 2 is a perspective view of a disassembled main portion of FIG. 1.

A needle bar support 26 supports the needle bar 10 such that the needle bar 10 can vertically slide. A needle 32 is attached through a clamp screw 30 and a needle connecting stud 28 with a thread guide 28*a* to the lower end of the needle bar 10. A threading mechanism 33 adjoins the needle bar support 26. The threading mechanism 33 includes a threading rod 34 provided in parallel with the needle bar 10 on the needle bar support 26. The threading rod 34 can rotate about its axis and slide vertically. As shown in FIG. 2, the threading rod 34 has a threading hook 36 on its lower end. When the threading rod 34 rotates about its axis, the threading hook 36 is rotated through a known linkage 38 toward an eye 32*a* in the needle 32.

As shown in FIG. 3, an actuating pin 40 is inserted and secured in its axial direction through the upper part of the threading rod 34. When the threading rod 34 lowers, the actuating pin 40 lowers and contacts the projection 24*a* of the positioning stopper 24. The positioning stopper 24 is secured through the screw 25 to the predetermined position of the needle bar 10 so that when the actuating pin 40 contacts the projection 24*a*, the threading hook 36 is lowered to the eye 32*a* in the needle 32.

As shown in FIG. 3, an actuating rod 42 is slidably inserted onto the threading rod 34, and a compression spring 44 is interposed between the actuating pin 40 and the actuating rod 42. As shown in FIG. 2, an S-shaped guide slot 46 extends upward in the outer periphery of the actuating rod 42. One end of the actuating pin 40 engages the guide slot 46. A contact surface 48 is formed on the upper end of the actuating rod 42 and projects along the radius of the threading rod 34. A hook 49 is formed on the outer periphery of the actuating rod 42. A spring 50 extends between the hook 49 and a hook (not shown) formed as one piece with the needle bar support 26. The spring 50 exerts an upward force on the actuating rod 42.

As shown in FIG. 1, one end of an L-shaped member 51 is rotatably inserted onto the upper end of the needle bar support 26. The other end of the L-shaped member 51 is rotatably attached through a screw 54 into a threading housing 52 secured to a sewing-machine housing (not shown). A spring 55 extends between the L-shaped member 51 and the needle bar frame 14, and exerts an upward force through the needle bar frame 14 to the needle bar 10.

A guide bar 56 is secured onto the threading housing 52 in parallel with the threading rod 34. A moving board 58 is slidably attached to the guide bar 56, separately from the actuating rod 42. The moving board 58 includes a slot 60 extending along the sliding direction of the moving board 58. A pin 62 on the guide bar 56 engages the slot 60, thus preventing the moving board 58 from rotating. A projection 64 is formed on the upper end of the moving board 58. As shown in FIG. 3, a reverse switch 65 is secured to the underside of the projection 64, such that, as shown in FIG. 2, when the moving board 58 slides down toward the needle 32, a switch body 65*a* contacts the contact surface 48. An operating portion 65*b* of the reverse switch 65 is arranged above an opening 48*a* in the contact surface 48. When the threading rod 34 protrudes from the opening 48*a* of the contact surface 48, and an upper end 34*a* of the threading rod 34 pushes the operating portion 65*b* of the reverse switch 65, the reverse switch 65 turns on.

As aforementioned, when the actuating rod 42 slides down, the threading rod 34 rotates, and the threading hook 36 is rotated ready to enter the eye 32*a* in the needle 32, the end 34*a* of the threading rod 34 pushes the operating portion 65*b* and turns on the reverse switch 65. A disconnecting pin 66 is provided in parallel with the clutch pin 20 on the lower end of the moving board 58.

A rotating shaft 70 is secured through two screws 68 in parallel with the guide bar 56 onto the needle bar support 26. A disconnecting board 72, which is supported on the rotating shaft 70, can rotate. A torsion spring 74 wound around the rotating shaft 70 puts the disconnecting board 72 in parallel with the axis of the clutch pin 20 and that of the disconnecting pin 66. A ridge 76, which is formed on the disconnecting board 72, slopes away from the disconnecting pin 66. When the moving board 58 and the disconnecting pin 66 rotate and lower, the disconnecting pin 66 presses down the ridge 76 and the disconnecting board 72 is rotated. While the needle bar 10 is vertically moving, the disconnecting board 72 can rotate and contact the clutch pin 20, thereby pressing up the clutch pin 20. The clutch pin 20 disconnects the clutch latch 18 from the groove 12. In the embodiment, as shown in FIGS. 1 and 2, the disconnecting board 72 is provided with a step 72*a* so that the disconnecting board 72 rotates but is prevented from raising the clutch pin 20 when the needle bar 10 is in its uppermost position.

As shown in FIG. 2, a flat piece 58*a* extends backward perpendicularly to the front surface having the slot 60 of the moving board 58. A rack 78 is provided at the side of the flat piece 58*a* of the moving board 58. The teeth of the rack 78 are formed transverse to the sliding direction of the moving board 58. The rack 78 meshes with a pinion 80 rotatably supported on the threading housing 52. The pinion 80 and a helical gear 82 form one member and are rotatably supported on the threading housing 52. A worm gear 86 is attached to a rotating shaft of a pulse motor 84 on the threading housing 52 and meshes with the helical gear 82.

On the other hand, as shown in FIG. 2, a stopper 88 is attached on the needle bar support 26 extending along the axis of the needle bar 10 such that the stopper 88 is a distance S away from the upper end of the needle bar 10. A presser bar 166 is supported in parallel with the needle bar 10 on a frame of the sewing machine such that the presser bar 166 can vertically move. The presser bar 166 has a presser foot assembly 170 for holding the cloth steady at its lower end. A presser bar guide bracket 174 is attached via a screw 172 to the presser bar 166. A coil spring 176 is wound around the presser bar 166 such that the coil spring 176 forces down the presser bar 166 through the presser bar guide bracket 174.

A lifting lever 178 is provided under the presser bar guide bracket 174 and is rotatably supported on the frame of the sewing machine. A presser foot raising actuator (not shown) adjoins the lifting lever 178 to raise the presser bar 166. A thread tension regulating cam (not shown) is formed on the lifting lever 178 and contacts one end of a release lever 186 rotatably supported via a support stud 184 on the frame of the sewing machine. When the lifting lever 178 is operated, the release lever 186 is rotated against the force of a spring 188.

A projection 190 is formed on the release lever 186 to turn on a presser-foot detecting switch 192 when the lifting lever 178 is rotated clockwise and the presser foot assembly 170 is raised.

As shown in FIG. 1, the arm shaft 1 for vertically moving the needle 32 is provided with an NP1 arm-shaft phase detector 194 and an NP2 arm-shaft phase detector 196. The NP1 arm-shaft phase detector 194 includes an NP1 shutter 198 rotating with the arm shaft 1, an NP1 LED 200 secured to the frame of the sewing machine, and an NP1 phototransistor 202. The NP2 arm-shaft phase detector 196 includes an NP2 shutter 204, an NP2 LED 206, and an NP2 phototransistor 208.

When the arm shaft 1 rotates to raise the needle 32 to its uppermost position, the rotation angle of the arm shaft 1 is 0°. While the arm shaft 1 further rotates about 15°, the NP1 arm-shaft phase detector 194 sends an NP1 signal. On the other hand, after the needle 32 reaches its uppermost position, the arm shaft 1 further rotates 45°. While the arm shaft 1 further rotates about 15° and the rotation angle of the arm shaft 1 is from 45° to 60°, the NP2 arm-shaft phase detector 196 sends an NP2 signal.

Figure 4:
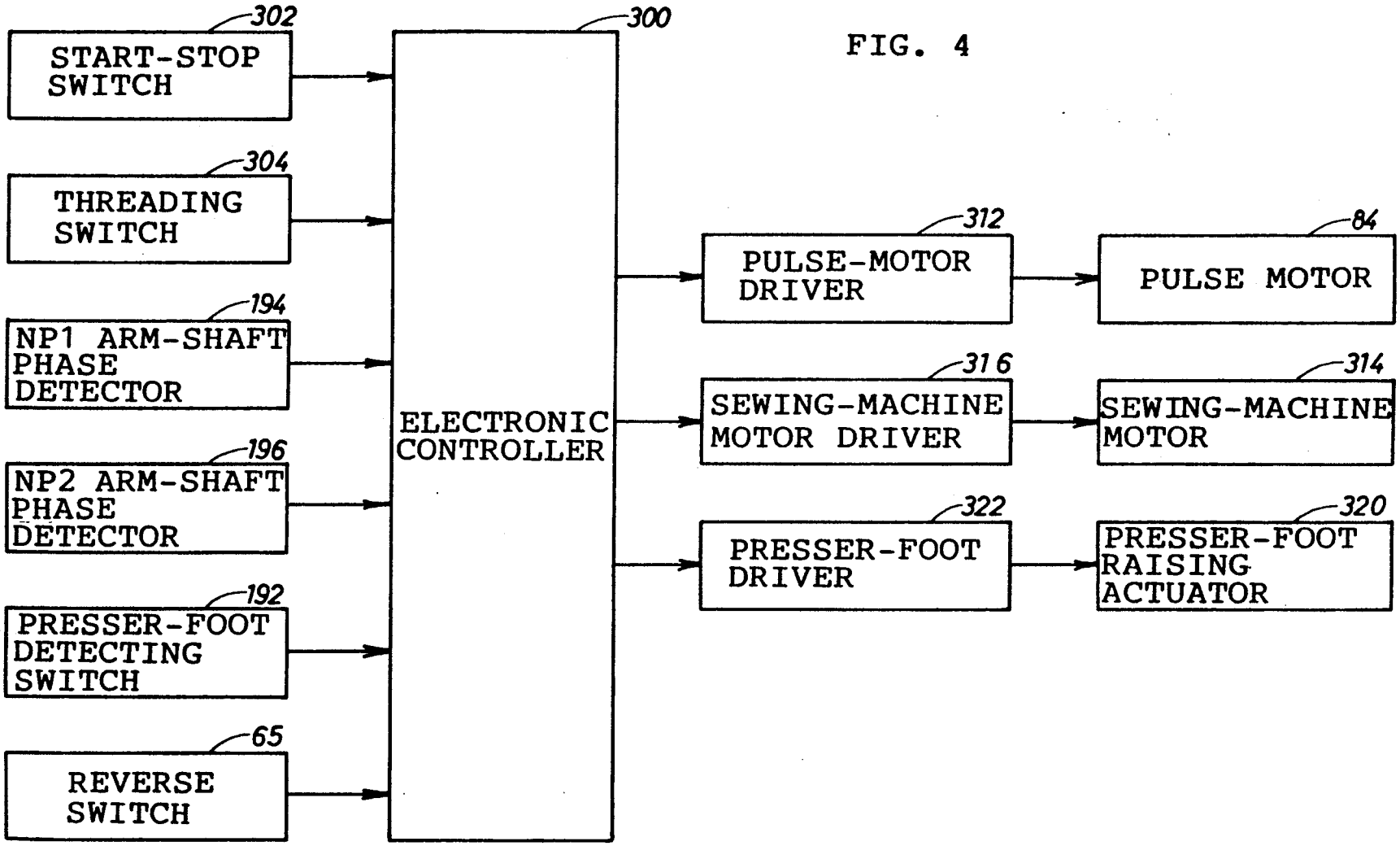
FIG. 4 is a schematic diagram of an electric structure for the embodiment.

An electric structure for the embodiment will now be explained referring to the block diagram in FIG. 4. The sewing machine for the embodiment is controlled by an electronic controller 300. The electronic controller 300 is connected to a start-stop switch 302 for instructing the starting and finishing of sewing operation, and a threading switch 304 for instructing threading operation. The electronic controller 300 is also connected to the NP1 arm-shaft phase detector 194 and the NP2 arm-shaft phase detector 196 for sending NP1 and NP2 signals, respectively, corresponding to the position of the needle bar 10 rising and lowering according to the rotation of the arm shaft 1, the presser-foot detecting switch 192, and the reverse switch 65. The electronic controller 300 sends control signals to a pulse-motor driver 312, a sewing-machine motor driver 316, and a presser-foot driver 322. The pulse-motor driver 312 sends pulses to the pulse motor 84. The sewing-machine motor driver 316 supplies power to a sewing-machine motor 314 for rotating the arm shaft 1. The presser-foot driver 322 sends control signals to a presser-foot rising actuator 320 for raising the presser foot assembly 170.

Figure 5A:
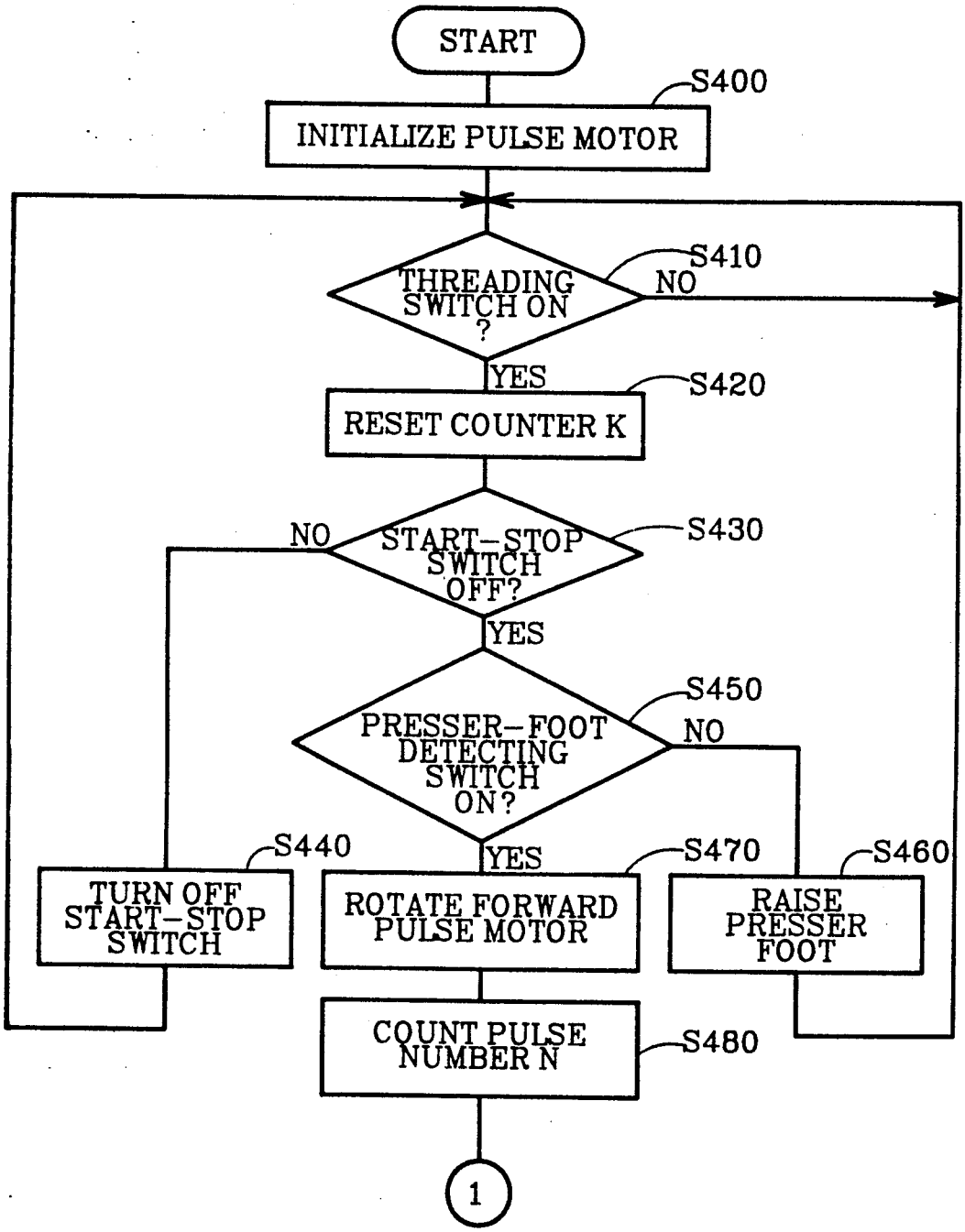
FIGS. 5A and 5B are flow charts of threading routine executed in a control circuit for the embodiment.
Figure 5B:
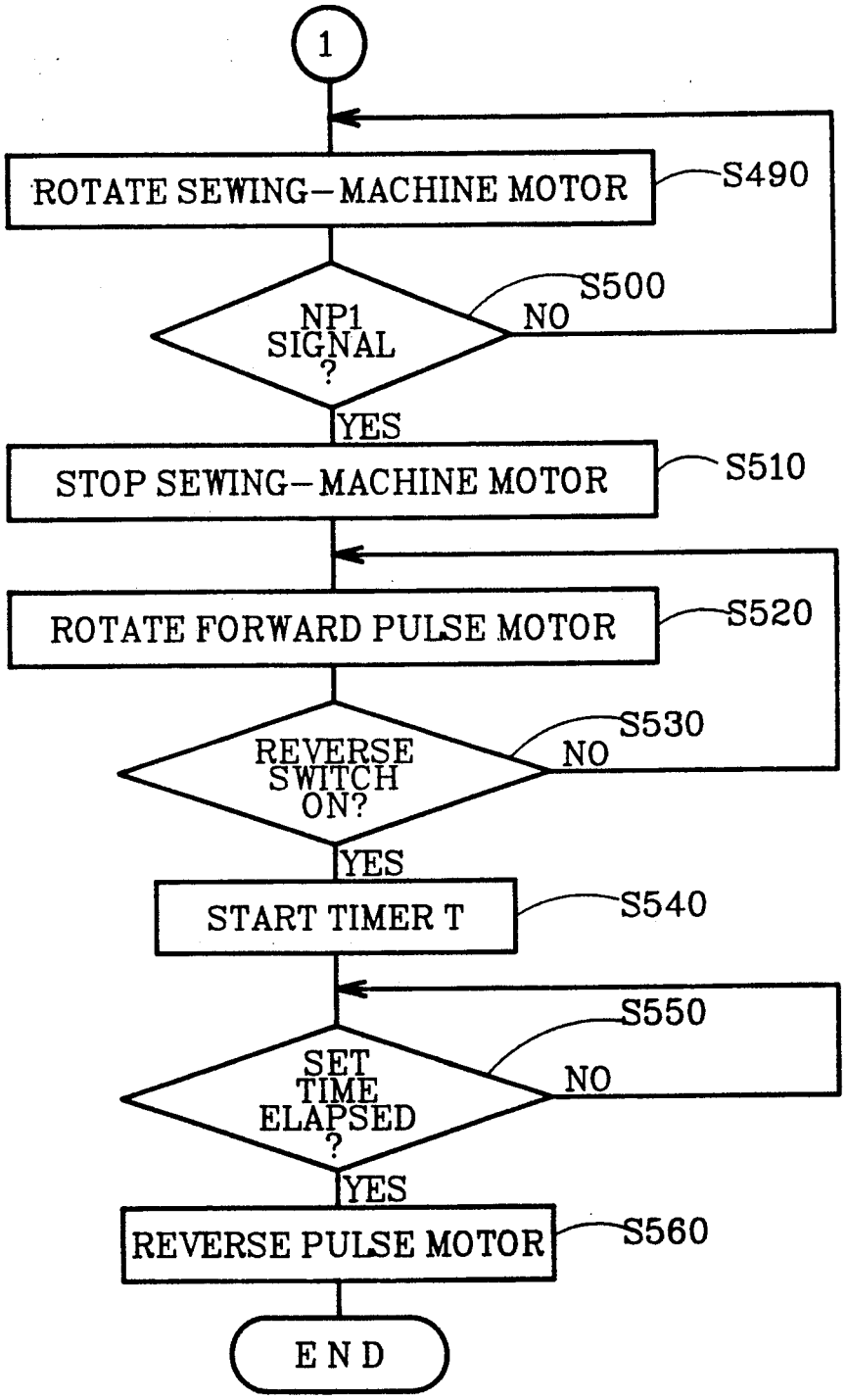

A threading routine will now be described referring to the flowchart of FIGS. 5A and 5B. After a power switch (not shown) on the sewing machine is turned on, step S400 initializes the pulse motor 84. An operator presses the threading switch 304 so that the eye 32*a* in the needle 32 is threaded prior to sewing operation. Step S410 determines whether the threading switch 304 is turned on. If at step S410 the threading switch 304 is on, step S420 resets a counter K for counting the rotation amount of the pulse motor 84, and step S430 determines whether the start-stop switch 302 is turned off. If at step S430 the start-stop switch 302 is on and the sewing-machine motor 314 is rotating, step S440 turns off the start-stop switch 302, thereby stopping the sewing-machine motor 314. While the process is waiting for step S410 where the threading switch 304 is turned on again, the operator passes the thread guided via a thread take-up (not shown) or the thread guide 28*a* of the needle bar 10 onto a given place of the linkage 38.

If at step S410 the threading switch 304 is on and at step S430 the start-stop switch 302 is off, step S450 determines whether the presser-foot detecting switch 192 is turned on and the presser foot assembly 170 is raised. If at step S450 the presser foot assembly 170 is not raised, step S460 raises the presser foot assembly 170 by sending signals to the presser-foot driver 322 for driving the presser-foot rising actuator 320. Subsequently, steps S410 through S450 are repeated.

After the process at steps S400 through S460 is executed, the sewing-machine motor 314 is stopped and the presser foot assembly 170 is raised. Subsequently, step S470 rotates forward the pulse motor 84 by a given number N of pulses PL. Step S480 adds the number N to the counter K. Consequently, the threading mechanism 33 is operated as follows.

When the pulse motor 84 rotates, such rotation is transmitted to the worm gear 86, the helical gear 82, and the pinion 80, and the rack 78, thereby lowering the moving board 58 along the guide bar 56.

When the moving board 58 lowers, the switch body 65*a* of the reverse switch 65 secured to the projection 64 of the moving board 58 contacts the contact surface 48 of the actuating rod 42. The actuating rod 42 is thus lowered against the force of the spring 50. When the actuating rod 42 lowers, the compression spring 44 and the actuating pin 40 engaging the guide slot 46 also lower, thereby lowering the threading rod 34. The linkage 38 and the threading hook 36 are also lowered.

Figure 6:
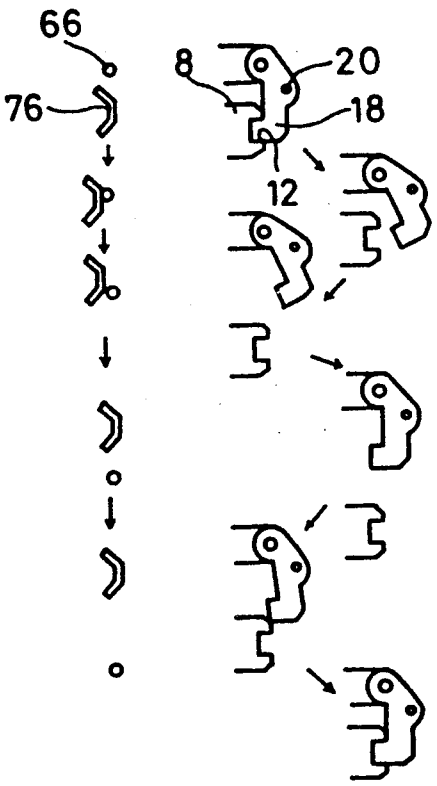
FIG. 6 illustrates the operation of a clutch click for the embodiment.

In the embodiment, when the pulse motor 84 rotates forward by the given pulses PL and the moving board 58 lowers a given distance L, as shown in FIG. 6, the disconnecting pin 66 presses in the ridge 76 of the disconnecting board 72 and the disconnecting board 72 is rotated outwardly. The clutch pin 20 of the click 18 is rotated forcibly outwardly about a vertical axis, thus disconnecting the clutch latch 18 from the groove 12. Subsequently, the needle bar 10 is pulled up by the force of the spring 55 until the upper end of the needle bar 10 contacts the stopper 88. In the embodiment, after the clutch latch 18 disengages from the groove 12, the needle bar 10 is raised to a position higher by the distance S than its uppermost position to which the rotation of the arm shaft 1 brings the needle bar 10. Even when the arm shaft 1 rotates to return the needle bar connecting stud 8 to its uppermost position, the clutch latch 18 fails to engage in the groove 12 of the needle bar connecting stud 8. Even when the arm shaft 1 vertically moves the needle bar connecting stud 8 by rotating, the needle bar 10 is not lowered or raised. When the arm shaft 1 rotates, the thread guide 28*a* holding thread guided from the linkage 38 fails to lower or rise. If the distance S between the stopper and the upper end of the needle bar 10 is zero, every time the arm shaft 1 raises the needle bar 10 for sewing operation, the needle bar 10 contacts the stopper 88, thereby causing noise. To avoid noise, the distance S should be larger than zero.

As aforementioned, when the pulse motor 84 rotates forward by the given pulses PL, the needle bar 10 is disengaged from the click 18 and the needle bar 10 rises to the stopper 88. Subsequently, step S490 rotates the sewing-machine motor 314 by sending the control signal to the sewing-machine motor driver 316. Step S500 determines whether the NP1 arm-shaft phase detector 194 sends the NP1 signal to the electronic controller 300. If at step S500 NP1 signal is issued, step S510 stops the sewing-machine motor 314. The arm shaft 1 is set in the position corresponding to the uppermost position of the needle bar 10. The arm shaft 1 is ready for connecting the needle bar 10.

After the arm shaft 1 is thus positioned, step S520 rotates forward the pulse motor 84 by sending the control signal to the pulse-motor driver 312. Step S530 determines whether the reverse switch 65 turns on.

When the pulse motor 84 rotates forward, the threading rod 34 and the actuating pin 40 lower, and the end of the actuating pin 40 contacts the projection 24*a* of the positioning stopper 24. On the other hand, the clutch latch 18 is disengaged from the groove 12 by the disconnecting board 72, and the needle bar 10 is pulled only by the force of the spring 55. By contacting the projection 24*a*, the actuating pin 40 lowers the needle bar 10. When the needle bar 10 lowers the distance S from the stopper 88, the click 18 engages in the groove 12 of the needle bar connecting stud 8 stopped in its uppermost position. Since the arm shaft 1 is stopped, no rotation of the arm shaft 1 is transmitted to the connecting rod 6 or the needle bar connecting stud 8. The needle bar 10 is thus stopped in its uppermost position, and the threading rod 34 is prevented from lowering further. When the moving board 58 is further lowered by the pulse motor 84, the actuating rod 42 lowers against the force of the compression spring 44. The actuating pin 40 slides in the guide slot 46, thereby rotating the threading rod 34. When the threading rod 34 rotates, the linkage 38 applies tension to thread in front of the eye 32*a* in the needle 32. The threading hook 36 is rotated by the linkage 38 toward the eye 32*a*. When the threading hook 36 is ready to penetrate the eye 32*a* in the needle 32, the reverse switch 65 turns on.

If at step S530 the reverse switch 65 turns on, step S540 starts a timer T, while continuing rotating forward the pulse motor 84. Step 550 determines whether time period set on the timer T has elapsed. If at step S550 the time period has elapsed, step S560 reverses the pulse motor 84 until the counter K counts down to zero.

Consequently, after the threading hook 36 is ready for going through the eye 32*a* in the needle 32, the threading hook 36 rotates during the time period set on the timer T. Subsequently, the pulse motor 84 is reversed by the number N of pulses required for rotating forward the pulse motor 84.

The threading hook 36 thus enters the eye 32*a* and catches thread. Subsequently, the pulse motor 84 reverses, and the moving board 58 rises. The actuating rod 42 also rises using the tensile force of the spring 50. The guide slot 46 also rises, and the actuating pin 40 slides in the guide slot 46 and rotates the threading rod 34 in reverse. The threading hook 36 is rotated by the linkage 38, and draws back with thread caught thereon from the eye 32*a* in the needle 32, thereby threading the eye 32*a*.

By threading the eye 32*a* and returning the threading rod 34 to its uppermost position, the threading process ends.

In the sewing machine for the embodiment, after the threading switch 304 is operated, the sewing-machine motor 314 is stopped. After thread is passed onto the linkage 38, the needle bar 10 is disconnected from the arm shaft 1. The needle bar 10 is raised to the stopper 88 regardless of the rotation of the arm shaft 1. Subsequently, thread from the linkage 38 is passed through the eye 32*a* in the needle 32 by the threading mechanism 33.

After thread guided via the thread guide 28*a* attached to the lower end of the needle bar 10 is passed onto the linkage 38 prior to threading operation, the thread guide 28*a* stays in its uppermost position or rises irrespective of the rotation of the arm shaft 1. The thread guide 28*a* is thus prevented from lowering, drawing thread from the bobbin and loosening thread stretched from the linkage 38. Proper tension is applied to thread stretched in front of the eye 32*a*. The threading mechanism 33 securely threads the eye 32*a* in the needle 32.

This invention has been described above with reference to the preferred embodiment. Modifications and alterations may become apparent to one skilled in the art upon reading and understanding the specification. It is intended to include all such modifications and alterations within the scope of the appended claims.

Figure 7:
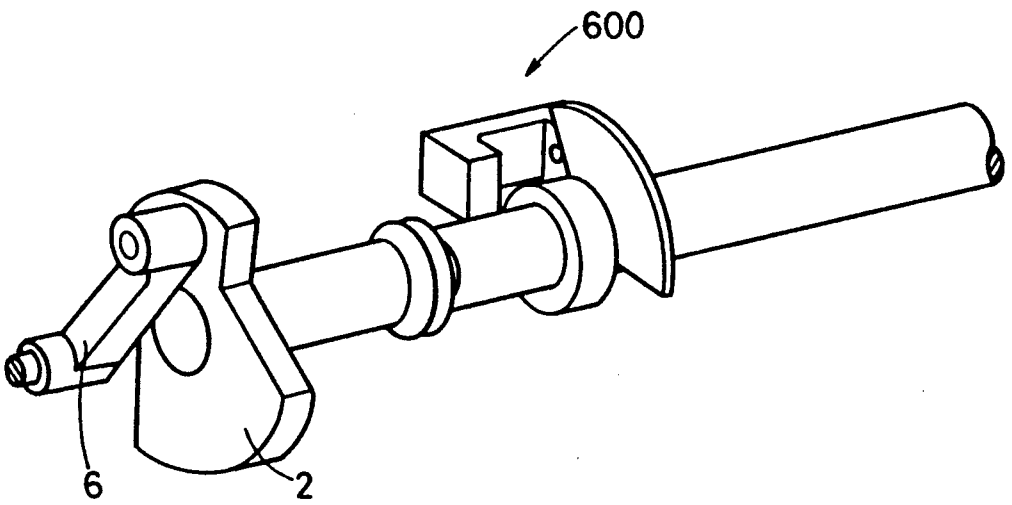
FIG. 7 is a perspective view of an arm-shaft phase detector for modified embodiment.

For example, in a sewing machine without a device for disconnecting the arm shaft from the needle bar 10, as shown in FIG. 7, the arm shaft 1 can be provided with an arm-shaft phase detector 600 that detects whether the needle bar 10 is lowering. If the arm shaft 1 is in phase where the needle bar 10 will lower, the threading switch 304 is operated, and the sewing-machine motor 314 is rotated in reverse to position the needle bar 10 in its uppermost position. If the arm shaft 1 is in phase where the needle bar 10 will rise, the sewing-machine motor 314 is rotated forward to position the needle bar 10 in its uppermost position.

In the embodiment, thread is stretched out from the linkage 38 to the front of the eye 32*a* in the needle 32. Thread can manually be stretched out in front of the eye 32*a*. If the end of thread is held in the operator's hand near the needle 32, the needle 32 never lowers during threading operation, thus giving no fear to the operator.

What is claimed is:

1. A raising and threading apparatus for raising a needle bar and threading a needle of a sewing machine, wherein the needle bar is movably mounted on a frame of the sewing machine, the needle is attached to one end of the needle bar, and the sewing machine further comprises a sewing transmission driven by a main drive means for moving the needle bar, the raising and threading apparatus comprising:

needle-bar raising means for raising the needle bar to a preparatory position prior to a threading operation;

threading means for threading the needle when the needle bar is raised to the preparatory position;

reversible drive means operatively connected to the threading means for moving the threading means toward and away from the needle;

detecting means for detecting a position of the threading means; and control means for controlling a drive direction of the reversible drive means; wherein the needle-bar raising means raises the needle bar to the preparatory position independently from the rotation of the main drive means and sewing transmission during a sewing operation.

2. The raising and threading apparatus of claim 1, wherein the needle-bar raising means comprises:

detecting means for detecting whether the main drive means and sewing transmission is raising or lowering the needle bar prior to the threading operation;

first control means for controlling the main drive means to rotate the sewing transmission in a normal sewing direction to raise the needle bar into the preparatory position when the detecting means detects that the sewing transmission is raising the needle bar; and second control means for controlling the main drive means to rotate the sewing transmission in a reverse direction to raise the needle bar into the preparatory position when the detecting means detects that the sewing transmission is lowering the needle bar.

3. The raising and threading apparatus of claim 1, wherein the needle-bar raising means comprises:

clutch means for disconnecting the sewing transmission from the needle bar prior to the threading operation; and retracting means for retracting the needle bar into the preparatory position.

4. The raising and threading apparatus of claim 3, wherein the clutch means comprises:

a needle bar connecting stud connected to the sewing transmission and slideably mounted on the needle bar such that the needle bar connecting stud is moveable in either direction along an axis of the needle bar;

clutch latch means rotatably attached to the needle bar for selectively attaching the needle bar connecting stud to or detaching the needle bar connecting stud from the needle bar; and actuating means for rotating the clutch latch means to detach the needle bar connecting stud from the needle bar.

5. The raising and threading apparatus of claim 4, wherein the actuating means comprises:

disconnecting means for disengaging the clutch latch means to detach the needle bar connecting stud from the needle bar when the disconnecting means rotates in a disconnecting direction; and drive means for moving a drive board relative to the needle bar along a line parallel to the needle bar, such that, when the drive means moves the drive board along the line towards the needle, the drive board contacts the disconnecting means and causes the disconnecting means to rotate in the disconnecting direction.

6. The raising and threading apparatus of claim 3, wherein the retracting means comprise a resilient retracting member attached between the frame and the needle bar for exerting a force on the needle bar away from the needle.

7. The raising and threading apparatus of claim 6, further comprising:

stop means attached to the frame along the needle bar axis for stopping the needle bar at a needle bar clutch position; wherein the needle bar is mounted on the frame such that the needle bar is moveable along the needle bar axis between the needle bar clutch position, in which a distal end of the needle bar away from the needle contacts the stop means, and a top sewing position, in which the distal end is a predetermined clutch distance away from the stop means; and when the clutch latch means detaches the needle bar connecting stud from the needle bar, the retracting member forces the needle bar from the top sewing position to the clutch position.

8. The raising and threading apparatus of claim 3, wherein the threading means comprises:

a threading rod mounted such that the threading rod is movable relative to the needle bar along and rotatable about a threading rod axis parallel to a needle bar axis;

threading hook extending means attached to a first end of the threading rod for extending a threading hook when the needle bar rotates about the needle bar axis; and an actuating cylinder mounted on a second end of the threading rod for rotating the needle bar about the needle bar axis when the needle bar is in the preparatory position.

9. A raising and threading apparatus of claim 1, wherein the threading means comprises:

threading hook extending means attached to a first end of the threading rod for extending a threading hook when the needle bar rotates about the needle bar axis; and an actuating cylinder mounted on a second end of the threading rod for rotating the needle bar about the needle bar axis when the needle bar is in the preparatory position.

10. The apparatus of claim 1, wherein the reversible drive means comprises a pulse motor.

11. The apparatus of claim 10, wherein the control means comprises a memory means for storing a number of pulses generated by the pulses generated by the pulse motor.

12. The apparatus of claim 11, wherein the control means further comprises timing means and switch means, such that the control means drives the pulse motor in a forward direction until the switch means is contacted, starts the timing means upon contact with the switch means, times a predetermined interval with the timing means, and drives the pulse motor in the reverse direction upon the elapse of the predetermined interval.

13. A raising and threading apparatus for raising a needle bar and threading a needle of a sewing machine, wherein the needle bar is movably mounted on a frame of the sewing machine, the needle is attached to one end of the needle bar, and the sewing machine further comprises a sewing transmission driven by a main drive means for moving the needle bar, the raising and threading apparatus comprising:

needle-bar raising means for raising the needle bar to a preparatory position prior to a threading operation;

a threading rod mounted such that the threading rod is movable relative to the needle bar along and rotatable about a threading rod axis parallel to a needle bar axis; and threading means mounted on the threading rod for threading the needle when a threading hook attached to the threading rod is in a threading position adjacent to the needle and the needle bar is raised to the preparatory position, the threading means comprising threading hook extending means attached to a first end of the threading rod for extending a threading hook when the needle bar rotates about the needle bar axis, and an actuating cylinder mounted on a second end of the threading rod for rotating the needle bar about the needle bar axis when the needle bar is in the preparatory position, wherein the needle-bar raising means raises the needle bar to the preparatory position independently from the rotation of the main drive means and sewing transmission during a sewing operation.

14. The raising and threading apparatus of claim 13, wherein the needle-bar raising means comprises:

detecting means for detecting whether the main motor and sewing transmission is raising or lowering the needle bar prior to the threading operation;

first control means for controlling the main drive means to rotate the sewing transmission in a normal sewing direction to raise the needle bar into the preparatory position when the detecting means detects that the sewing transmission is raising the needle bar; and second control means for controlling the main drive means to rotate the sewing transmission in a reverse direction to raise the needle bar into the preparatory position when the detecting means detects that the sewing transmission is lowering the needle bar.

15. The raising and threading apparatus of claim 13, wherein the needle-bar raising means comprises:

clutch means for disconnecting the sewing transmission from the needle bar prior to the threading operation; and retracting means for retracting the needle bar into the preparatory position.

16. The raising and threading apparatus of claim 15, wherein the clutch means comprises:

a needle bar connecting stud connected to the sewing transmission and slidably mounted on the needle bar such that the needle bar connecting stud is moveable in either direction along an axis of the needle bar;

clutch latch means rotatably attached to the needle bar for selectively attaching the needle bar connecting stud to or detaching the needle bar connecting stud from the needle bar; and actuating means for rotating the clutch latch means to detach the needle bar connecting stud from the needle bar.

17. The raising and threading apparatus of claim 16, wherein the actuating means comprises:

disconnecting means for disengaging the clutch latch means to detach the needle bar connecting stud from the needle bar when the disconnecting means rotates in a disconnecting direction; and drive means for moving a drive board relative to the needle bar along the threading rod along a line parallel to the needle bar, such that, when the drive means moves the drive board along the threading rod towards the needle, the drive board contacts the disconnecting means and causes the disconnecting means to rotate in the disconnecting direction.

18. The raising and threading apparatus of claim 15, wherein the retracting means comprise a resilient retracting member attached between the frame and the needle bar for exerting a force on the needle bar away from the needle.

19. The raising and threading apparatus of claim 18, further comprising:

stop means attached to the frame along the needle bar axis for stopping the needle bar at a needle bar clutch position; wherein the needle bar is mounted on the frame such that the needle bar is movable along the needle bar axis between the needle bar clutch position, in which a distal end of the needle bar away from the needle contacts the stop means, and a top sewing position, in which the distal end is a predetermined clutch distance away from the stop means; and when the clutch latch means detaches the needle bar connecting stud from the needle bar, the retracting member forces the needle bar from the top sewing position to the clutch position.

20. A raising and threading apparatus for raising a needle bar and threading a needle of a sewing machine, wherein the needle bar is movably mounted on a frame of the sewing machine, the needle is attached to one end of the needle bar, and the sewing machine further comprises a sewing transmission driven by a main drive means for moving the needle bar, the raising and threading apparatus comprising:

clutch means for disconnecting the sewing transmission from the needle bar prior to the threading operation;

a resilient retracting member attached between the frame and the needle bar for exerting a force on the needle bar away from the needle to retract the needle bar into the preparatory position when the clutch means disconnects the sewing transmission from the needle bar;

a threading rod mounted such that the threading rod is movable relative to the needle bar along and rotatable about a threading rod axis parallel to a needle bar axis; and threading means mounted on the threading rod for threading the needle when a threading hook attached to the threading rod is in a threading position adjacent to the needle and the needle bar is raised to the preparatory position;

wherein the clutch means comprises a needle bar connecting stud connecting to the sewing machine transmission and slidably mounted on the needle bar such that the needle bar connecting stud is movable in either direction along an axis of the needle bar, clutch latch means rotatably attached to the needle bar for selectively attaching the needle bar connecting stud to or detaching the needle bar connecting stud from the needle bar, and actuating means for rotating the clutch latch means to detach the needle bar connecting stud from the needle bar, the actuating means comprising disconnecting means for disengaging the clutch latch means to detach the needle bar connecting stud from the needle bar when the disconnecting means rotates in a disconnecting direction, and drive means for moving a drive board relative to the needle bar along the threading rod, along a line parallel to the needle bar, such that when the drive means moves the drive board along the threading rod towards the needle, the drive board contacts the disconnecting means and causes the disconnecting means to rotate in the disconnecting direction.

21. The raising and threading apparatus of claim 20, further comprising:

stop means attached to the frame along the needle bar axis for stopping the needle bar at a needle bar clutch position; wherein the needle bar is mounted on the frame such that the needle bar is movable along the needle bar axis between the needle bar clutch position, in which a distal end of the needle bar away from the needle contacts the stop means, and a top sewing position, in which the distal end is a predetermined clutch distance away from the stop means; and when the clutch latch means detaches the needle bar connecting stud from the needle bar, the retracting member forces the needle bar from the top sewing position to the clutch position.

* * * * *